US006899566B2

(12) United States Patent
Kline et al.

(10) Patent No.: US 6,899,566 B2
(45) Date of Patent: May 31, 2005

(54) CONNECTOR ASSEMBLY INTERFACE FOR L-SHAPED GROUND SHIELDS AND DIFFERENTIAL CONTACT PAIRS

(75) Inventors: Richard S. Kline, Mechanicsburg, PA (US); Juergen Lappoehn, Gammelshausen (DE)

(73) Assignee: ERNI Elektroapparate GmbH, Adelberg (DE)

( * ) Notice: Subject to any disclaimer, the term of this patent is extended or adjusted under 35 U.S.C. 154(b) by 0 days.

(21) Appl. No.: 10/197,386

(22) Filed: Jul. 17, 2002

(65) Prior Publication Data

US 2003/0143894 A1 Jul. 31, 2003

Related U.S. Application Data

(60) Provisional application No. 60/352,298, filed on Jan. 28, 2002.

(51) Int. Cl.[7] ..... H01R 13/648
(52) U.S. Cl. ..... 439/608; 439/108
(58) Field of Search ..... 439/608, 108, 439/607, 701, 901, 609

(56) References Cited

U.S. PATENT DOCUMENTS

| | | | | |
|---|---|---|---|---|
| 4,846,727 A | * | 7/1989 | Glover et al. | 439/608 |
| 4,975,084 A | | 12/1990 | Fedder et al. | 439/608 |
| 5,066,236 A | | 11/1991 | Broeksteeg | |
| 5,238,414 A | | 8/1993 | Yaegashi et al. | 439/108 |
| 5,620,340 A | * | 4/1997 | Andrews | 439/608 |
| 5,660,551 A | * | 8/1997 | Sakurai | 439/108 |
| 5,664,968 A | | 9/1997 | Mickievicz | |
| 5,795,191 A | * | 8/1998 | Preputnick et al. | 439/608 |
| 6,116,926 A | * | 9/2000 | Ortega et al. | 439/108 |
| 6,224,432 B1 | | 5/2001 | Billman | |
| 6,231,391 B1 | * | 5/2001 | Ramey et al. | 439/608 |
| 6,343,955 B2 | | 2/2002 | Billman et al. | 439/608 |
| 6,347,962 B1 | | 2/2002 | Kline | |
| 6,371,813 B2 | | 4/2002 | Ramey et al. | 439/608 |
| 6,506,076 B2 | | 1/2003 | Cohen et al. | 439/608 |
| 6,527,587 B1 | | 3/2003 | Ortega et al. | 439/608 |
| 2001/0010979 A1 | | 8/2001 | Ortega et al. | 439/79 |
| 2003/0022555 A1 | | 1/2003 | Vicich et al. | 439/608 |

FOREIGN PATENT DOCUMENTS

| | | | |
|---|---|---|---|
| WO | WO 99/26321 | 5/1999 | H01R/13/658 |
| WO | WO 01/29931 A1 | 4/2001 | |

* cited by examiner

*Primary Examiner*—Tho D. Ta
*Assistant Examiner*—Edwin A. Leon

(57) ABSTRACT

An electrical connector assembly is provided having a header connector and a receptacle connector matable with one another. An array of signal contacts are secured to the header connector and arranged in differential contact pairs. The differential contact pairs are configured to carry differential signal pairs. An array of L-shaped ground shields are secured to the header connector. Optionally, a second side may be added to the L-shape to form a C-shaped ground shield. Each ground shield is arranged to partially surround and isolate a corresponding differential contact pair from adjacent differential contact pairs. The receptacle contact includes a mating face having an array of contact receiving holes and ground shield receiving notches. The contact receiving holes are arranged in differential hole pairs corresponding to, and matable with, the differential contact pairs. The ground shield receiving notches are configured to be matable with the ground shields. The signal contacts in each differential contact pair are spaced apart by a contact-to-contact distance. Adjacent differential contact pairs are spaced apart by a contact pair-to-pair distance that is greater than the contact-to-contact distance. The L-shaped ground shields and contact spacing cooperate to more closely electromagnetically couple signal contacts in a differential contact pair to one another than to signal contacts in adjacent differential contact pairs.

15 Claims, 9 Drawing Sheets

CONNECTOR ASSEMBLY INTERFACE FOR L-SHAPED GROUND SHIELDS AND DIFFERENTIAL CONTACT PAIRS

RELATED APPLICATIONS

The present application relates to, and claims priority from, co-pending application Ser. Nos. 09/772,642 and 60/352,298 filed on Jan. 30, 2001 and Jan. 28, 2002 and entitled "Terminal Module Having Open Side For Enhanced Electrical Performance" and "Connector Assembly Interface For L-Shaped Ground Shields and Differential Contact Pairs", respectively. The co-pending applications name Richard Scott Kline as the sole inventor and are incorporated by reference herein in their entirety including the specifications, drawings, claims, abstracts and the like.

BACKGROUND OF THE INVENTION

Certain embodiments of the present invention generally relate to an electrical connector assembly mating interface in which L-shaped ground shields isolate differential contact pairs from one another.

It is common, in the electronics industry, to use right angled connectors for electrical connection between two printed circuit boards or between a printed circuit board and conducting wires. The right angled connector typically has a large plurality of pin receiving terminals and, at right angles thereto, pins (for example compliant pins) that make electrical contact with a printed circuit board. Post headers on another printed circuit board or a post header connector can thus be plugged into the pin receiving terminals making electrical contact there between. The transmission frequency of electrical signals through these connectors may be very high and require, not only balanced impedance of the various contacts within the terminal modules to reduce signal lag and reflection, but also shielding between rows of terminals to reduce crosstalk.

Impedance matching of terminal contacts has already been discussed in U.S. Pat. Nos. 5,066,236 and 5,496,183. Right angle connectors have also been discussed in these patents, specifically how the modular design makes it easier to produce shorter or longer connectors without redesigning and re-tooling for an entirely new connector, and only producing a new housing part into which a plurality of identical terminal modules are assembled. As shown in the '236 patent, shielding members can be interposed between adjacent terminal modules. An insert may be used to replace the shield or a thicker terminal module may be used to take up the interposed shielding gap if the shielding is not required. The shield disclosed in the '236 patent is relatively expensive to manufacture and assemble. The shielded module disclosed in the '183 patent includes a plate-like shield secured to the module and has a spring arm in the plate section for electrically engaging an intermediate portion of a contact substantially encapsulated in a dielectric material. The shield arrangement of the '183 patent, however, requires sufficient space between adjacent through-holes of the board to avoid inadvertent short circuits. Furthermore, both the insulated module and the shield must be modified if the ground contact is to be relocated in the connector.

An alternative electrical connector assembly has been proposed in U.S. Pat. No. 5,664,968, in which each terminal module has a plurality of contacts including a mating contact portion, a connector portion and an intermediate portion there between with some or all of the intermediate portion encapsulated in an insulated web. Each module has an electrically conductive shield mounted thereto. Each shield includes at least a first resilient arm in electrical engagement with a selected one of the contacts in the module to which the shield is mounted and at least a second resilient arm extending outwardly from the module and adapted for electrical engagement with another selected contact in an adjacent terminal module of the connector assembly.

An alternative connector apparatus has been disclosed in U.S. Pat. No. 6,231,391. The '391 patent describes a header connector including a header body, a plurality of signal pins, a continuous strip having a plurality of shield blades formed thereon, and a plurality of ground pins. The header body includes a front wall having a plurality of signal pin-receiving openings, a plurality of shield blade-receiving openings, and a plurality of ground pin-receiving openings. The shield blade-receiving openings are formed to have a generally right angle cross-section. A plurality of shield blades are also formed with a generally right angle cross-section and are located adjacent to individual signal pins such that each signal pin is provided with a corresponding ground shield.

Conventional connector assemblies, such as in the '236, '183, '968 and '391 patents, are designed for use both in at least single-ended applications and may also be used in differential pair applications. In single-ended applications, the entire signal content is sent in one direction contained between ground and one conductor and then the entire signal content is subsequently returned in the opposite direction contained between ground and a different conductor. Each conductor is connected to a pin or contact within a connector assembly, and thus the entire signal content is directed in one direction through one pin or contact and in the opposite direction through a separate pin or contact. In differential applications, the signal is divided and transmitted in the first direction over a pair of conductors (and hence through a pair of pins or contacts). The return signal is similarly divided and transmitted in the opposite direction over the same pair of conductors (and hence through the same pair of pins or contacts).

The differences in the signal propagation path of single-ended versus differential pair applications cause differences in the signal characteristics. Signal characteristics may include impedance, propagation delay, noise, skew, and the like. The signal characteristics are also affected by the circuitry used to transmit and receive the signals. The circuitry involved in transmitting and receiving signals differs entirely for single-ended and differential applications. The differences in the transmission and reception circuitry and the signal propagation paths yield different electrical characteristics, such as impedance, propagation delay, skew and noise. The signal characteristics are improved or deteriorated by varying the structure and configuration of the connector assembly. The structure and configuration for connector assemblies optimized for single-ended applications differ from connector assemblies optimized for use in differential pair applications.

Heretofore, it has been deemed preferable to offer a common connector assembly useful in both single-ended and differential pair application. Consequently, the connector assembly is not optimized for either applications. A need remains for a connector assembly optimized for differential pair applications.

Moreover, most connector assemblies must meet specific space constraints depending upon the type of application in which the connector assembly is used while maintaining high signal performance. By way of example only, certain computer specifications, such as for the Compact PCI specification, define the dimensions for an envelope, in which the connector assembly must fit, namely an HM-type connector which represents an industry standard connector. However, the HM connector does not necessarily offer adequate signal performance characteristics desirable in all applications. Instead, in certain applications, higher signal characteristics may be preferable, such as offered by the HS3 connector offered by Tyco Electronics Corp. It may also be preferable to use connectors suitable for frequencies higher than supported by HS3 connectors. However, certain conventional connectors that offer higher signal characteristics may not satisfy the envelope dimensions of certain connector standards.

The connector of the '391 patent provides ground shielding about each individual signal pin. One-to-one correspondence between each ground shield and each signal pin necessitates that the signal pins be spaced apart by a rather large distance. The distance between signal pins must be sufficient to accommodate an associated ground shield and retain adequate header body material to avoid compromising the integrity of the connector housing.

Further, each and every signal pin in the '391 patent is evenly spaced from all adjacent signal pins. Consequently, each signal pin is equally likely to become electromagnetically (EM) coupled to any of the surrounding signal pins. To avoid EM coupling, the ground shields in the '391 patent are structured to attempt to isolate each signal pin. The ground shields do not achieve total isolation between certain signal pins (e.g. diagonally). To the extent that the signal pins are not isolated by the ground shields, the signal pins are spaced far from one another to further reduce EM coupling. This spacing undesirably expands the overall size of the connector assembly.

A need remains for a connector assembly for differential pair applications capable of satisfying small envelope dimensions, while affording high quality signal performance characteristics.

BRIEF SUMMARY OF THE INVENTION

In accordance with an embodiment of the present invention, an electrical assembly is provided comprising a header connector and an array of signal contacts secured to the header connector and arranged in a pattern of signal contact pairs. The electrical connector assembly also includes a receptacle connector including a mating face having an array of contact receiving holes. The contact receiving holes are arranged in hole pairs corresponding to the pattern. The hole pairs are matable with the signal contact pairs and each hole pair includes first and second holes spaced apart by a hole-to-hole distance that differs from a hole paired to pair distance between adjacent hole pairs. In an alternative embodiment, the mating face of a receptacle connector includes an array of L-shaped notches adapted to receive ground shields, where each L-shaped notch is arranged on the mating face to partially surround a corresponding hole pair. Optionally, the L-shaped notches may be aligned in rows and columns to define a pattern on the mating face of the receptacle connector that constitutes a differential interface pattern. Each L-shaped notch may further include a blade receiving portion and a leg receiving portion. The leg receiving portions have a length that differs from the length of the blade receiving portions. The blade receiving portion of each L-shaped notch extends parallel to, and along, both contact receiving holes in a corresponding hole pair. The blade receiving portion of each L-shaped notch may be aligned parallel to a differential hole pair axis that extends through both contact receiving holes in a corresponding hole pair. The L-shaped notches extend along one side of both contact receiving holes in a corresponding hole pair and along only one end of the corresponding hole pair. An opposite end of the corresponding hole pair is left open or exposed.

In accordance with at least one embodiment, an array of L-shaped ground shields are secured to the header connector. Each L-shaped ground shield is arranged on the header connector to partially surround and isolate a corresponding one of the signal contact pairs from adjacent signal contact pairs. A first L-shaped ground shield isolates adjacent first and second signal contact pairs arranged in a common column of the pattern. The first L-shaped ground shield also isolates the first signal contact pair from an adjacent third signal contact pair arranged in a common row of the pattern as the first signal contact pair. Only a single L-shaped ground shield need be located between adjacent signal contact pairs in each row and each column of the pattern. Similarly, only a single L-shaped notch need be located between adjacent hole pairs in each row in each column of the pattern. Optionally, a second side may be added to the L-shape to form a C-shaped ground shield.

Each hole pair is oriented along a respective hole pair axis extending through centers of respective first and second contact receiving holes. Each of the L-shaped notches include a blade notch portion that is aligned parallel to the corresponding hole pair axis. Each L-shaped notch may further include a leg notch portion that is aligned perpendicular to the corresponding hole pair axis.

In accordance with at least one embodiment, an electrical connector assembly is provided having a header with a header mating face and contacts extending from the header and configured to carry different signal pairs. The contacts are organized in multiple differential pairs that are arranged on the header mating face in a contact pattern with adjacent differential pairs aligned in rows and columns. Each differential pair includes two contacts spaced apart by a first distance, while adjacent differential pairs in the rows and columns are spaced by a second distance that is greater than the first distance. A receptacle is provided having a receptacle mating face with holes arranged in a hole pattern corresponding to the contact pattern. The receptacle is matable with the header. An array of L-shaped notches is provided that are adapted to receive ground shields, with each L-shaped notch being arranged on the receptacle mating face to partially surround the corresponding pair of holes receiving a respective differential pair of contacts. Optionally, the notches may be formed with two leg receiving portions on opposite ends of the blade receiving portion to form a C-shaped notch.

An array of ground shields may be secured to the header and extend from the header mating face, wherein each ground shield includes a blade portion extending along at least one side of an associated differential pair of contacts and includes one or two leg portions extending along one or both ends of an associated differential pair of contacts.

In accordance with one embodiment, an electrical connector assembly is provided having a header connector and a receptacle connector matable with one another. The electrical connector assembly includes a plurality of contacts receivable within contact receiving holes provided in at least one of the header and receptacle contacts. The contacts are arranged in differential contact pairs, with each differential contact pair being oriented along a respective differential contact pair axis. Each differential contact pair is configured to carry a differential signal. A plurality of L-shaped ground shields are receivable within L-shaped ground shield notches provided in the header and receptacle contacts, respectively. Each L-shaped ground shield is located proximate, and oriented to partially surround, the corresponding differential contact pair.

BRIEF DESCRIPTION OF SEVERAL VIEWS OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

Figure 1:
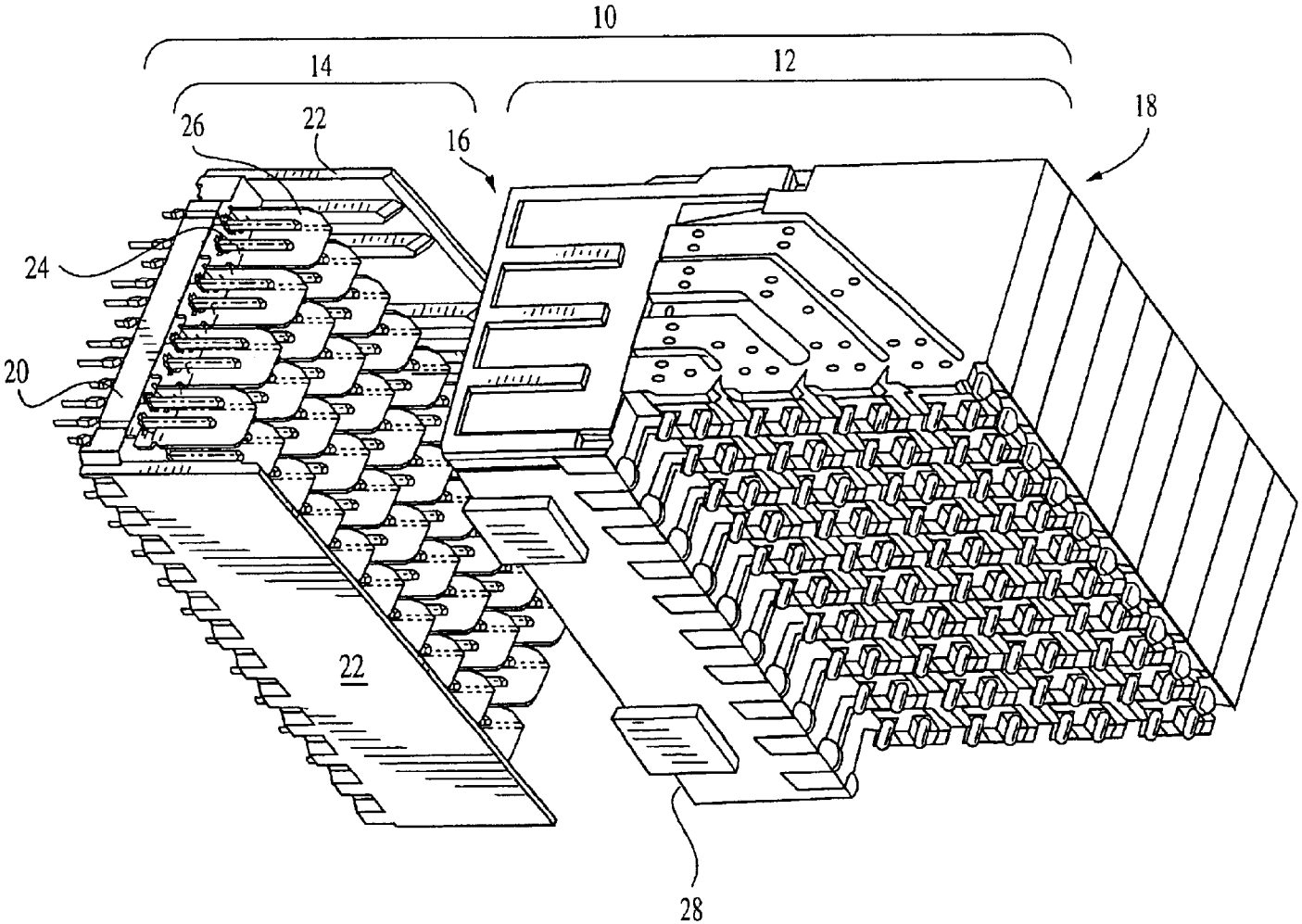
FIG. 1 illustrates an isometric view of a connector assembly formed in accordance with an embodiment of the present invention.

FIG. 1 illustrates a connector assembly 10 including a receptacle 12 and a header 14. An insulated housing 16 is provided as part of the receptacle 12. Multiple terminal modules 18 (also referred to as chiclets) are mounted in the insulated housing 16. The header 14 includes a base 20 and sidewalls 22. The base 20 retains an array or matrix of header contacts 24 and header contact ground shields 26. By way of example only, the header contacts 24 may be formed as rectangular pins. The insulated housing 16 includes a mating face 28 having a plurality of openings therein aligned with the header contacts 24 and header contact ground shields 26. The header contact ground shields 26 and header contacts 24 are joined with receptacle contacts and receptacle grounds contained in the terminal modules 18 (as explained in more detail below).

Figure 2:
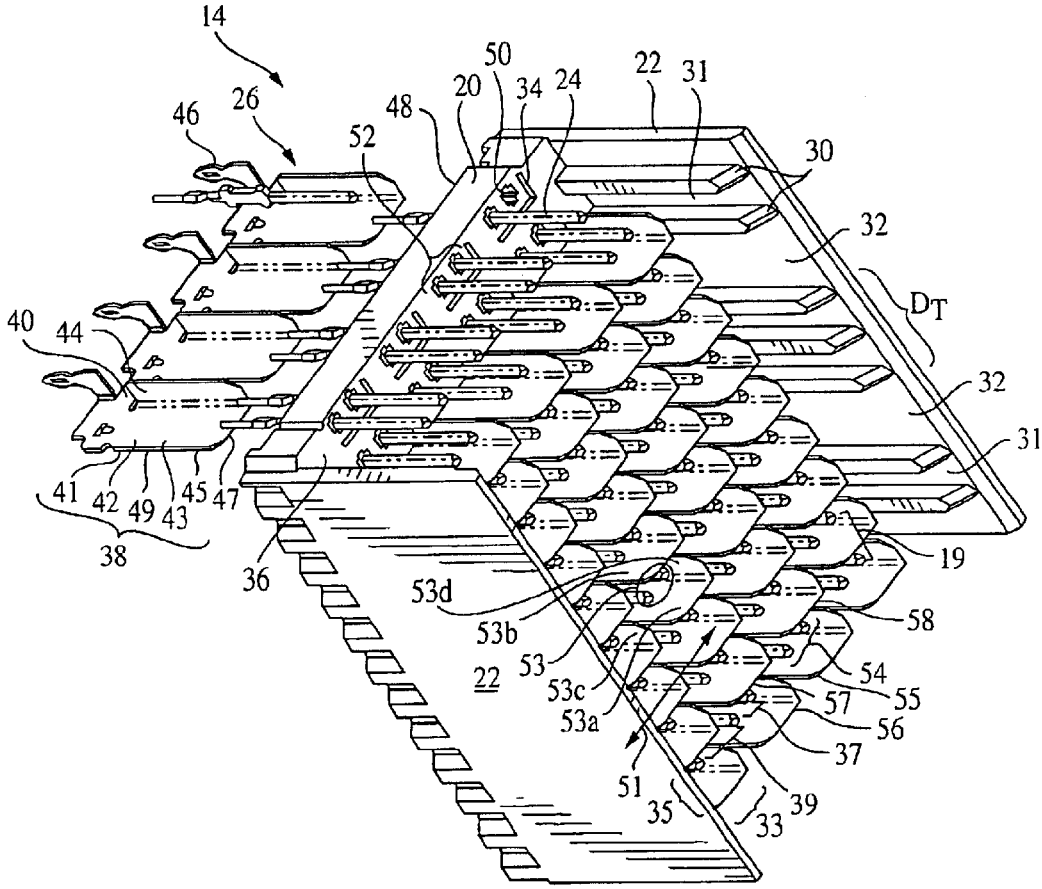
FIG. 2 illustrates an exploded isometric view of a header, header contacts and header ground shields formed in accordance with an embodiment of the present invention.
Figure 8:
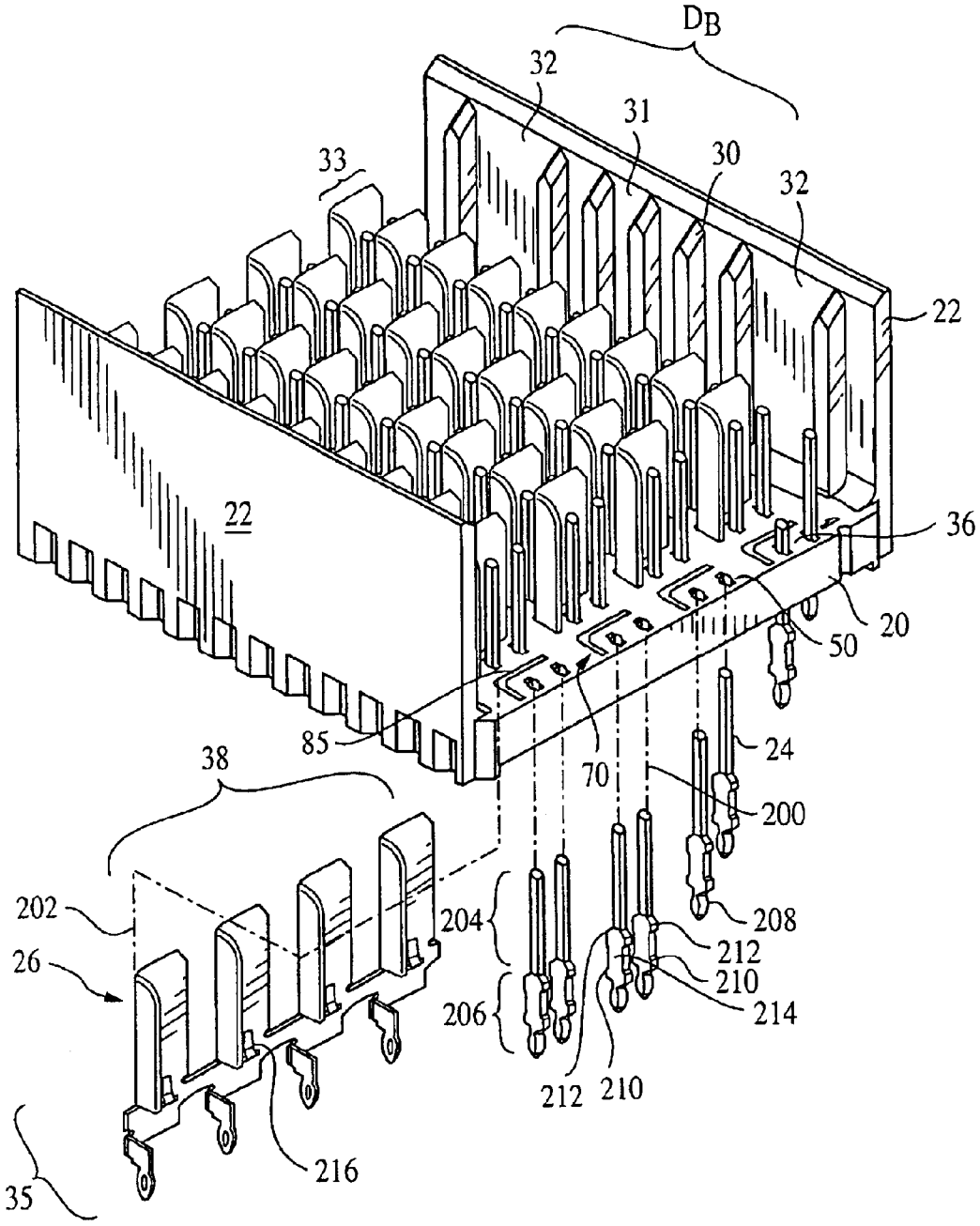
FIG. 8 illustrates an exploded isometric view of a header, header contacts and header ground shields formed in accordance with an embodiment of the present invention.

FIGS. 2 and 8 illustrate isometric views of the header 14 in more detail. The sidewalls 22 include a plurality of ribs 30 formed on the interior surfaces thereof. Gaps 31 are formed between the ribs 30 as part of a void core manufacturing process. Void coring may be used to avoid the formation of sink holes in the sidewalls 22. Groups of ribs 30 may be separated by large gaps to form guide channels 32 that are used to guide the header 14 and receptacle 12 onto one another. The guide channels 32 may also be formed with different widths in order to operate as a polarizing feature to ensure that the receptacle 12 is properly oriented before mating with the header 14. The guide channels 32 as seen in FIG. 2 are spaced apart a distance $D_T$. The guide channels 32 as seen in FIG. 8 are spaced from one another by a distance $D_B$.

Figure 3:
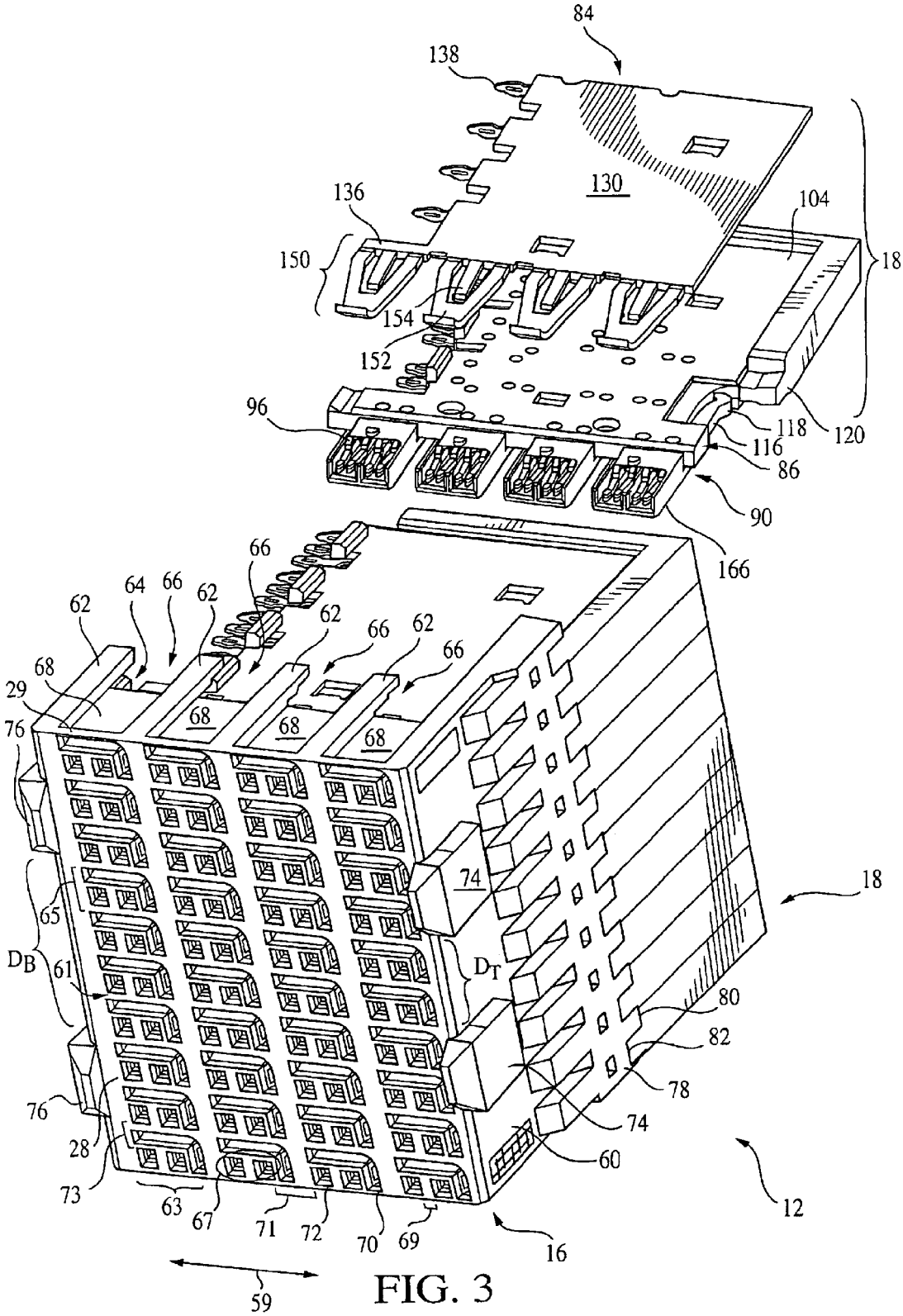
FIG. 3 illustrates an exploded isometric view of a receptacle formed in accordance with an embodiment of the present invention.

FIG. 8 illustrates the interior of the sidewall 22 opposite to that of FIG. 2. The sidewall 22 (for which the interior is illustrated in FIG. 8) includes a plurality of ribs 30 separated by gaps 31 and guide elements 32. The sidewalls 22 illustrated in FIG. 8 include five ribs 30 separated by narrow gaps 31. Singular ribs 30 are spaced on opposite ends of the sidewall 22 to define the guide elements 32. Guide elements 32 are spaced apart by a distance $D_B$ and accept bottom keying projections 76 (FIG. 3).

The base 20 of the header 14 includes a plurality of L-shaped notches 34 cut there through. The L-shaped notches 34 are aligned in rows and columns to define a pattern or matrix across the mating face 36 of the header 14 corresponding to the contact interface pattern. The mating face 36 of the header 14 is located in close proximity and may abut against the mating face 28 on the receptacle 12 when the connector assembly 10 is fully joined. The header 14 receives a plurality of ground shield segments 38, each of which includes one or more header contact ground shields 26 (in the example of FIG. 2 it includes four). A ground shield segment 38 may be stamped from a single sheet of metal and folded into a desired shape. Carrier 40 joins the header contact ground shields 26. Each header contact ground shield 26 includes a blade portion 42 and a leg portion 44 bent to form an L-shape. Optionally, a second leg portion may be bent along a side of the blade portion 42 opposite to leg portion 44 to form a C-shape. Ground shield contacts 46 are stamped from the same piece of metal as the remainder of the ground shield segment 38 and are integral with the header contact ground shields 26.

While not illustrated in FIG. 2, slots are provided along the rear surface 48 of the base 20 between notches 34 to receive the carriers 40 until flush with the rear surface 48. The slots between the notches 34 do not extend fully through the base 20 to the mating face 36. The blades 42 includes a front surface 43 and a rear surface 45, a base 41, an intermediate portion 49, and tip 47. The base 41 is formed with the carriers 40. The tip 47 extends beyond the outer end of the header contacts 24.

The base 20 also includes a plurality of header contact holes 50 cut there through. The header contact holes 50, in the example of FIG. 2, are arranged in pairs 52 in order to receive corresponding pairs of header contacts 24. Each pair 52 of holes 50 is located in the interior of a corresponding L-shaped notch 34 such that the associated pair of header contacts 24 are shielded on two sides by the blade portion 42 and leg portion 44 of the corresponding contact ground shields 26. By configuring the contact ground shields 26 to partially enclose each pair of header contacts 24, each pair of header contacts 24 is substantially surrounded on all sides by contact ground shields 26. By way of example, header contact pair 54 may be surrounded by blade and/or leg portions of contact ground shields 55–58. The contact ground shields 26 surround each pair of header contacts 24 to also control the operating impedance of the connector assembly 10 when carrying high frequency signals. Each header contact pair 54 is configured to carry a differential pair signal.

The notches 34 and hole pairs 52 are arranged to locate the header contacts 24 and header ground shields 26 in an array or pattern fanned of rows 33 and columns 35. The header contacts 24 in each header contact pair 54 are spaced apart by a contact-to-contact spacing 37. In each column 35, adjacent header contact pairs 54 are spaced apart by a contact pair-to-pair spacing 39. In each row 33, adjacent header contact pairs 54 are spaced apart by contact pair-to-pair spacing 19. The contact-to-contact spacing 37 is less than the contact pair-to-pair spacings 39 and 19. By providing contact-to-contact spacing 37 for each header contact pair 54 that is closer than the contact pair-to-pair spacings 39 and 19, header contacts 24 in a single header contact pair 54 are more strongly EM coupled to one another than to header contacts 24 in adjacent header contact pairs 54.

Each header contact pair 54 is oriented parallel to, and extends along, a header contact pair axis 51. Each header contact pair 54 is isolated from adjacent header contact pairs 54 by the header ground shields 26. By way of example, header contact pair 53 is isolated from the adjacent header contact pairs 54 in the same row 33 by blade portions 53*a* and 53*b* located proximate opposite sides of the header contact pair 54. The header contact pair 53 is isolated from adjacent header contact pairs 54 in the same column 35 by leg portions 53*c* and 53*d* located proximate opposite ends of the header contact pair 54. By isolating each header contact pair 54, the header contacts 24 in a single header contact pair 54 are more strongly EM coupled to one another than to header contacts 24 in adjacent header contact pairs 54.

FIG. 3 illustrates a receptacle 12, from which one terminal module 18 has been removed and partially disassembled. The receptacle 12 includes an insulated housing 16 formed with a mating face 28. The mating face 28 on the receptacle 12 is formed with a plurality of L-shaped notches 70 and contact receiving holes 72. The notches 70 and holes 72 are aligned to receive the contact ground shields 26 and header contacts 24 (FIG. 2). The notches 70 and holes 72 are aligned in an array representing a differential interface pattern 61 corresponding to a differential signal\ground pattern, in which the header contacts 24 and header ground shields 26 are arranged. The differential interface pattern 61 includes an array of contact receiving holes 72. The contact receiving holes 72 are grouped in differential hole pairs 67. The contact receiving holes 72 in each differential hole pair 67 extend along a differential hole pair axis 59 extending through centers of the contact receiving holes 72 in the differential hole pair 67. The differential hole pairs 67 are formed in rows 63 and columns 65. In each differential hole pair 67, the contact receiving holes 72 are separated by a hole-to-hole spacing 69.

Figure 6:
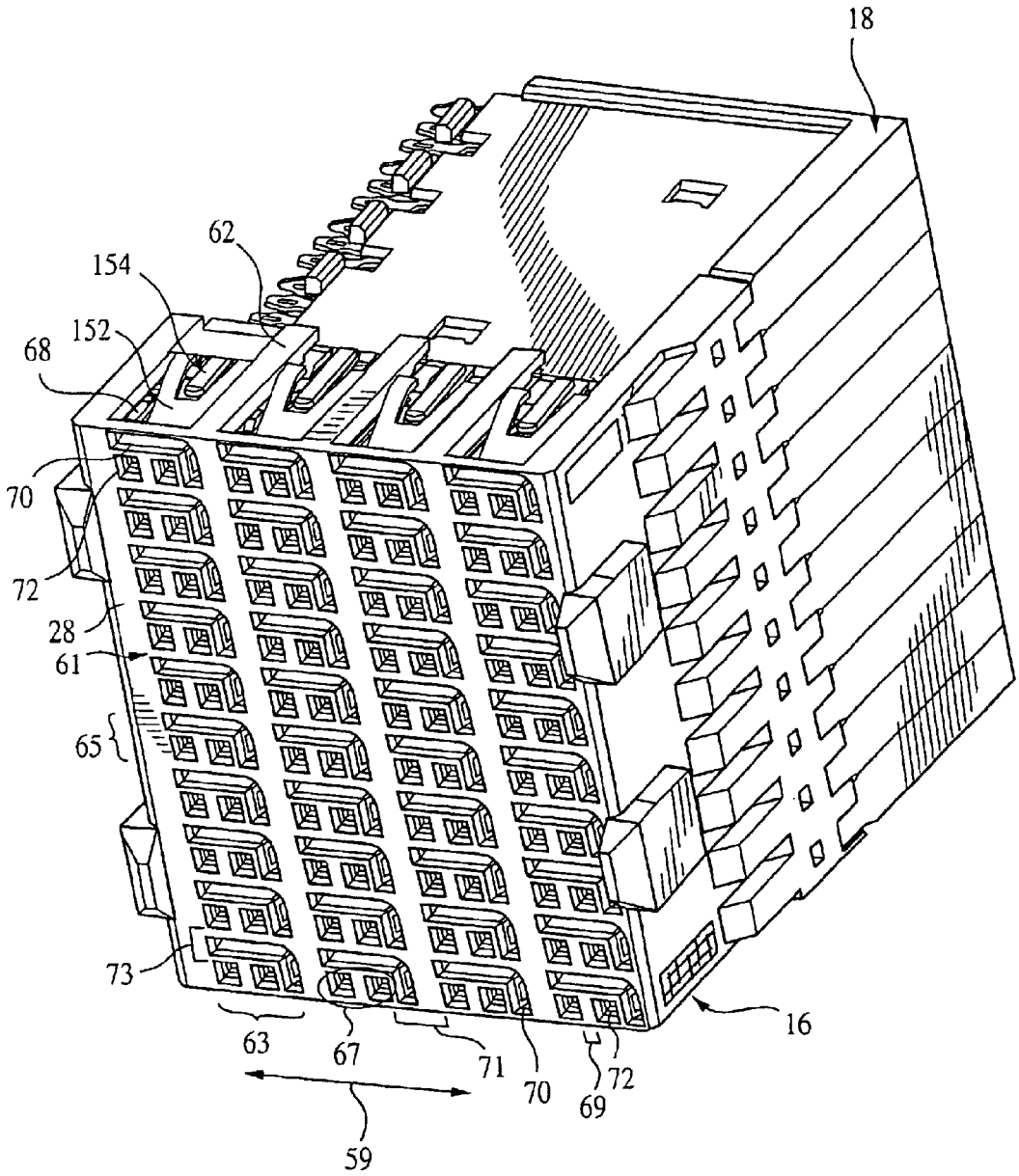
FIG. 6 illustrates an isometric view of a receptacle formed in accordance with an embodiment of the present invention.
Figure 7:
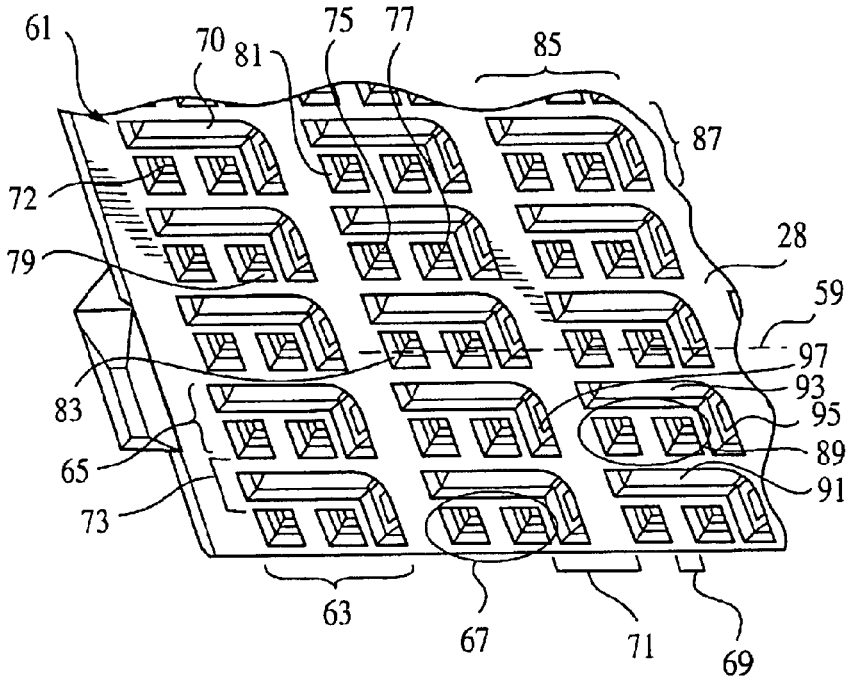
FIG. 7 illustrates a partial top plan view of a portion of a receptacle interface pattern formed in accordance with an embodiment of the present invention.

As best shown in FIGS. 6 and 7, the differential hole pairs 67 in a common column 65 are separated by a pair-to-pair spacing 71. The differential hole pairs in a common row 63 are separated by a pair-to-pair spacing 73. The pair-to-pair spacings 71 and 73 are illustrated in the drawings as measured from edges of the corresponding contact receiving holes 72 by way of example only. Optionally, the pair-to-pair spacings 71 and\or 73 may be measured from the center or opposite edges of the contact receiving holes 72. The pair-to-pair spacings 71 and 73 may equal one another. Optionally, the pair-to-pair spacings 71 and 73 may differ from one another depending upon the shape and dimensions of the contact receiving notches 70.

The hole-to-hole spacing 69 is less than the pair-to-pair spacing 71 and the pair-to-pair spacing 73 in order that the contact receiving holes 72 within a single differential hole pair 67 are more closely electro-magnetically (EM) coupled to one another than to any contact receiving hole 72 in an adjacent differential hole pair 67. More specifically, with reference to FIG. 7, contact receiving hole 75 is spaced closer, and is more strongly EM coupled, to contact receiving hole 77 than to contact receiving holes 79, 81 and 83. Contact receiving hole 75 is also spaced closer, and is more strongly EM coupled, to contact receiving hole 77 than to any other contact receiving hole 72 in the surrounding differential hole pairs 67.

Next, the configuration of the notches 70 in the mating face 28 are explained in more detail in connection with FIG. 7. Each notch 70 includes a blade receiving portion 85 joined with a leg receiving portion 87. The blade and leg receiving portions 85 and 87 cooperate to partially surround an associated differential hole pair 67. The notches 70 are formed in a pattern corresponding to the differential interface pattern 61 of differential hole pairs 67. All of the blade and leg receiving portions 85 and 87 are oriented in a similar manner, such that each differential hole pair 67 is isolated from adjacent differential hole pairs 67. The blade receiving portions 85 extend parallel to the differential hole pair axis 59 of a corresponding differential hole pair 67. The leg receiving portion 87 extends perpendicular to the differential hole pair axis 59 of the corresponding differential hole pair 67. Optionally, the notches 70 may be formed with two leg receiving portions 87 being formed on opposite ends of the blade receiving portion 85 to form a C-shaped notch.

By way of example only, the differential hole pair 89 is isolated from differential hole pairs 67 in the same rows 63 by first and second blade portions 91 and 93 provided on opposite sides of the differential hole pair 89. The differential hole pair 89 is isolated from differential hole pairs 67 in the same column 65 by first and second leg receiving portions 95 and 97 provided at opposite ends of the differential hole pair 89. The spacing between differential hole pairs 67 and the arrangement and orientation of the notches 70 cooperate to isolate each differential hole pair 67. The contact receiving holes 72 in a single differential hole pair 67 need not be isolated from one another, but instead are preferably EM coupled to one another to enhance signal performance.

Returning to FIG. 3, a plurality of support posts 62 projects rearward from the mating face 28 of the base 29 of the insulated housing 16. The insulated housing 16 includes a top wall 60 formed with, and arranged to extend rearward from, the base 29. The top wall 60 and support posts 62 cooperate to define a plurality of slots 64, each of which receives one terminal module 18. The insulated housing 16 includes a plurality of top and bottom keying projections 74 and 76, respectively. The top keying projections 74 are spaced a distance $D_T$ apart from one another, while the bottom keying projections 76 are spaced a distance $D_B$ from one another. The distances $D_T$ and $D_B$ differ to distinguish the top and bottom keying projections 74 and 76 from one another. The keying projections 74 and 76 are received within the guide channels 32 (FIGS. 2 and 8) located on the interior surfaces of the sidewalls 22 of the header 14.

The top wall 60 also includes a module support bracket 78 extending along a width of the top wall 60. The rear end 80 of the module support bracket 78 includes a plurality of notches 82 formed therein to receive upper ends of the terminal modules 18. Locking features are provided on the lower surface of the module support bracket 78 to secure the terminal modules 18 in place. The support posts 62 are formed in rows and columns. By way of example, the receptacle 12 in FIG. 3 illustrates four support posts 62 formed in each row, while the groups of four support posts 62 are provided in 11 columns. The support posts 62 define 10 slots 64 that receive 10 terminal modules 18. The support posts 62 and top wall 60 are spaced apart from one another to form, along each row of support posts 62, a series of gaps 66. In the example of FIG. 3, four gaps 66 are provided along each row of support posts 62. The gaps 66 between the support posts 62 and between the support posts 62 and top wall 60 are filled with thin insulating walls 68 that operate as a dielectric to cover the open side on the terminal module 18 as explained below in more detail.

FIG. 8 illustrates the header 14 of FIG. 2, but oriented differently and with one column 35 of header contacts 24 and header ground shields 26 partially disassembled. Dashed lines 200 and 202 indicate the manner by which the header contacts 24 and header ground shields 26 are inserted into the base 20. Each header contact 24 includes a stem portion 204 extending upward from one end of a mounting segment 206. The opposite end of each mounting segment 206 includes a flared tip 208 configured to be mounted to a structure such as a circuit board and the like. Each mounting segment 206 has a body portion 214 that is generally rectangular in shape. The body portion 214 is formed with embossments 210 and 212 provided on opposing sides thereof and located near opposite ends.

The holes 50 in the base 20 are formed with a contour substantially conforming to the contour of the mounting segments 206. For instance, the holes 50 may be formed with a rectangular cross-section that may include recesses on opposite sides of the rectangle. The distance between the recesses is sufficient to avoid abrasion of the functional areas of the header contacts 24. When the header contacts 24 are assembled with the header 14, the embossments 210 and 212 are accepted in, and frictionally engage, the holes 50. The embossments 210 are positioned flush with the mating face 36 of the base 20. Optionally, the embossments 212 may also be positioned flush with the rear surface 48 of the base 20.

The ground shield segments 38 may be formed with ramped projections 216 extending from the ground blade portions 42. The ramped projections 216 are inserted into and frictionally engage the blade receiving portions 85 of the notches 70, thereby holding the ground shield segments 38 within the base 20. Optionally, the ramped projections 216 may be omitted and the ground shield segments 38 held in place by forming the carrier 40 longer than a length of a corresponding slot.

Figure 9:
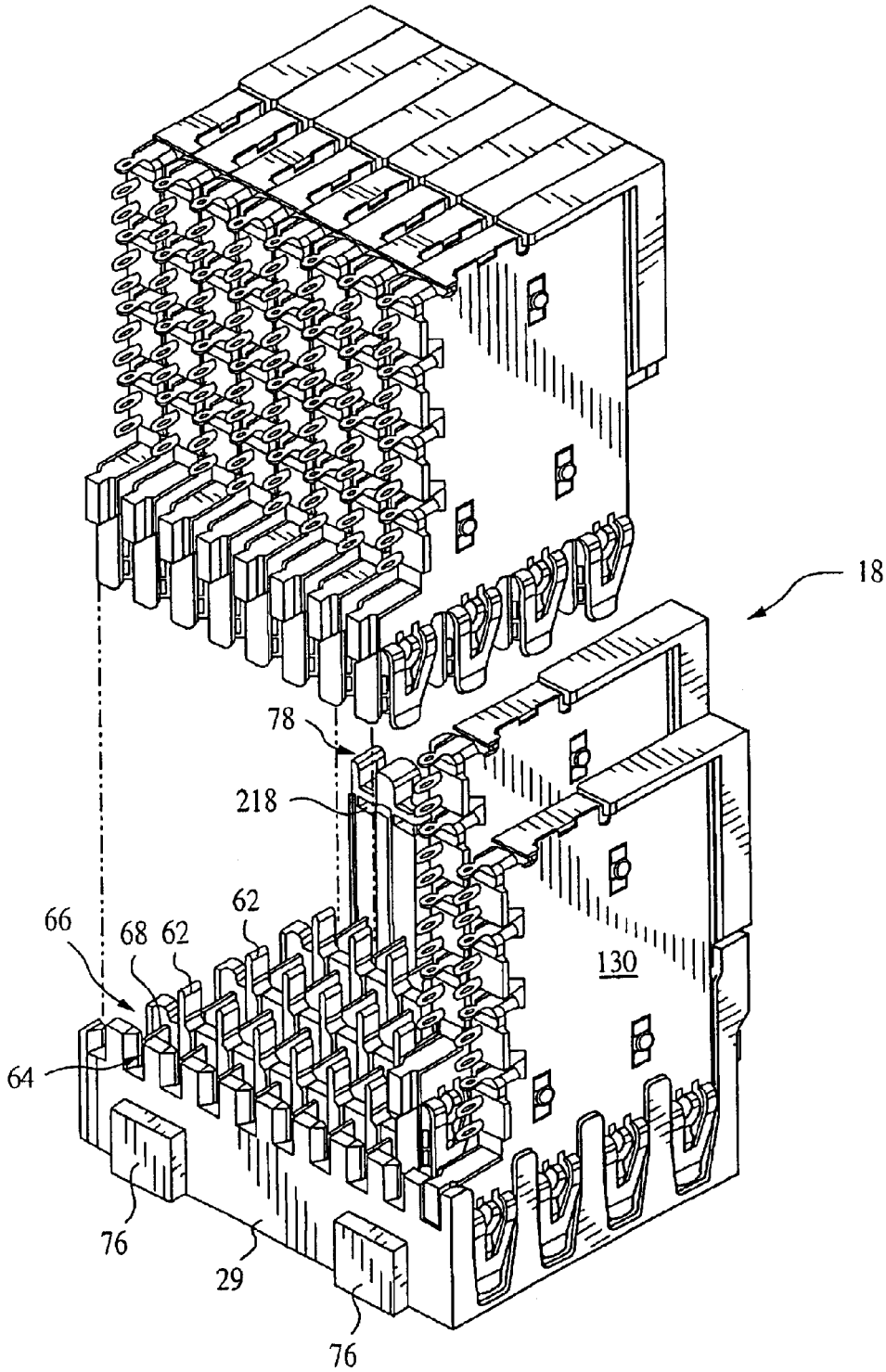
FIG. 9 illustrates an exploded isometric view of a receptacle and terminal modules formed in accordance with an embodiment of the present invention.

FIG. 9 illustrates the receptacle 12 with multiple terminal modules 18 removed. As better shown in FIG. 9, the insulated housing 16 includes support posts 62 that project rearward from the base 29. The posts 62 define the slots 64 that receive each terminal module 18. The gaps 66 between support posts 62 are filled with insulated walls 68 that cover the open side on the terminal modules 18.

Figure 4:
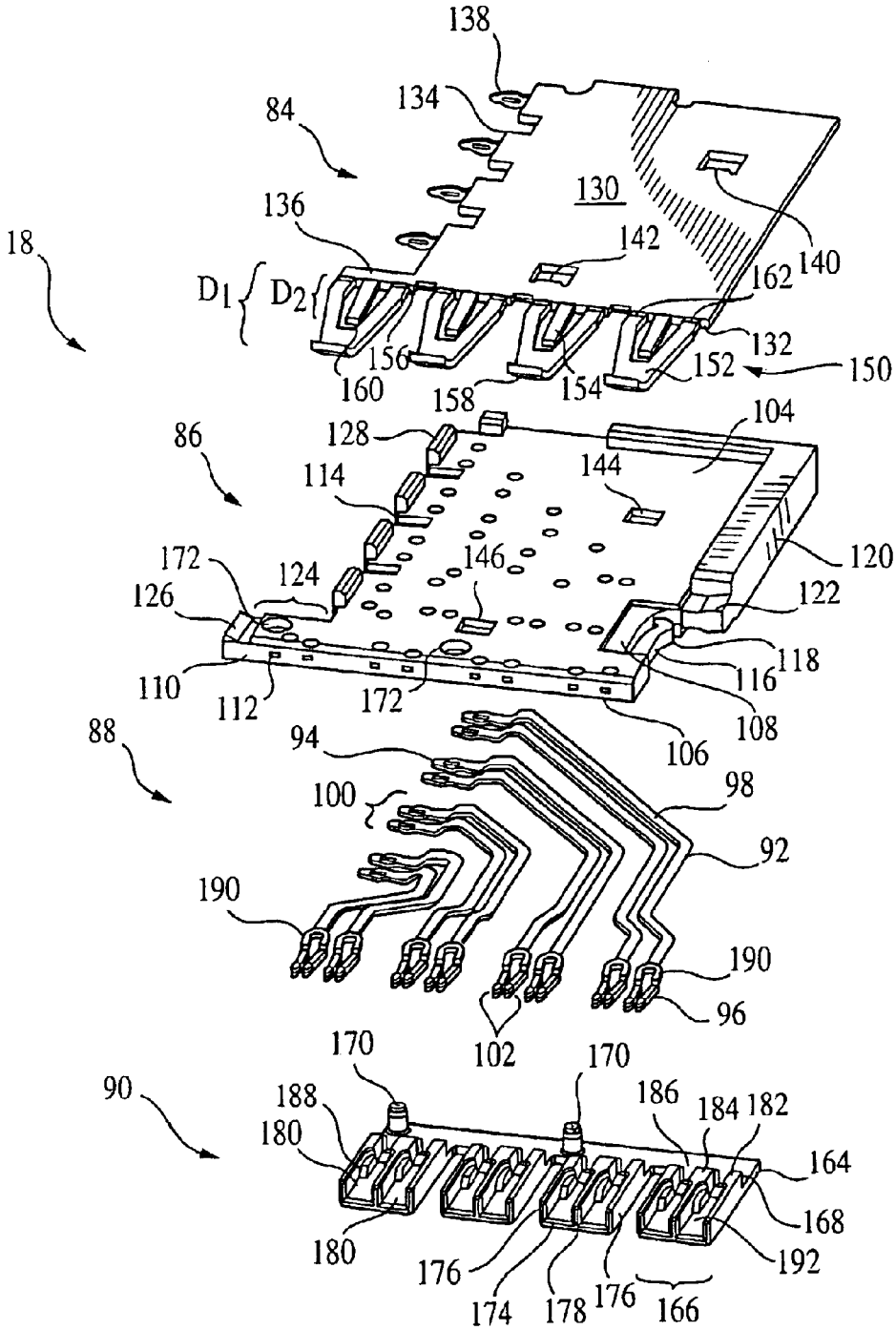
FIG. 4 illustrates an exploded isometric view of a terminal module formed in accordance with an embodiment of the present invention.

FIG. 4 illustrates a terminal module 18 separated into its component parts. The terminal module 18 includes a module ground shield 84 that is mounted to a plastic over-molded portion 86. The over-molded portion 86 retains a lead frame 88. A cover 90 is mounted to one end of the over-molded portion 86 to protect the receptacle contacts 96 that are located along one end of the lead frame 88. The lead frame 88 is comprised of a plurality of leads 92, each of which includes a board contact 94 and a receptacle contact 96. Each board contact 94 and corresponding receptacle contact 96 is connected through an intermediate conductive trace 98. By way of example, the leads 92 may be arranged in lead differential pairs 100. In the example of FIG. 4, four lead differential pairs 100 are provided in each terminal module 18. By way of example only, the receptacle contacts 96 may be formed in a "tuning fork" shape with opposed fingers 102 biased toward one another. The fingers 102 frictionally and conductively engage a corresponding header contact 24 when the receptacle 12 and header 14 are fully mated. The board contacts 94 may be inserted into corresponding slots in a computer board and connected with associated electrical traces.

The over-molded portion 86 includes top and bottom insulated layers 104 and 106 that are spaced apart from one another to define a space 108 there between in which the lead frame 88 is inserted. The over-molded portion 86 includes a front edge 110 having a plurality of openings 112 therein through which the receptacle contacts 96 project. The over-molded portion 86 also includes a bottom edge 114 having a similar plurality of openings (not shown) through which the board contacts 94 extend. A latch arm 116 is provided along the top of the over-molded portion 86. The over-molded portion 86 includes an L-shaped bracket 120 located along the top edge thereof and along the back edge to provide support and rigidity to the structure of the terminal module 18. The bracket 120 includes a V-shaped wedge 122 on the front end thereof. The V-shaped wedge 122 is slidably received within a corresponding inverted V-shape within the notches 82 in the module support bracket 78. The wedges 122 and notches 82 cooperate to insure precise alignment between the terminal module 18 and the insulated housing 16.

The latch arm 116 includes a raised ledge 118 on the outer end thereof to snappingly engage a corresponding feature on the interior surface of the module support bracket 78. As shown in FIG. 9, the interior surface of the module support bracket 78 includes cavities 218 that receive the raised ledges 118 on corresponding terminal modules 18.

The terminal module 18 also includes an extension portion 124 proximate the front edge 110 and extending downward beyond the bottom edge 114. The extension portion 124 projects over an edge of a board upon which the terminal module 18 is mounted and into which the board contacts 94 are inserted. The outer end of the extension portion 124 includes a wedge embossment 126 extending outward at least along one side of the extension portion 124. The embossment 126 is received within a corresponding notch formed between adjacent support posts 62 along the bottom of the insulated housing 16 to insure proper alignment between the terminal module 18 and the insulated housing 16. The over-molded portion 86 includes a series of projections 128 extending upward from the bottom edge 114. The projections 128 and bracket 120 cooperate to define a region in which the module ground shield 84 is received. The module ground shield 84 is mounted against the top layer 104 of the over-molded portion 86. The module ground shield 84 includes a main body 130, with a front edge 132 and a bottom edge 134. An extended ground portion 136 is arranged along the front edge 132 and projects downward below the bottom edge 134. The extended ground portion 136 overlays the extension portion 124 to reside along an end of a board upon which the terminal module 18 is mounted. The bottom edge 134 includes a plurality of board grounding contacts 138 that conductively connect the module ground shield 84 to grounds on the board. The main body 130 includes two latching members 140 and 142 that extend through holes 144 and 146, respectively, in the top layer 104.

The latch members 140 and 142 secure the module ground shield 84 to the over-molded portion 86.

The module ground shield 84 includes a plurality of ground contact assemblies 150 mounted to the front edge 132. Each ground contact assembly 150 includes a primary ground contact 152 and a secondary ground contact 154. Each ground contact assembly 150 is mounted to the main body 130 through a raised ridge 156. The primary ground contacts 152 include outer ends 158 that are located a distance $D_1$ beyond the front edge 132. The secondary ground contacts 154 include an outer end 160 located a distance $D_2$ beyond the front edge 132. The outer end 158 of the primary ground contacts 152 is located further from the front edge 132 than the outer end 160 of the secondary ground contacts 154. In the example of FIG. 4, the primary ground contacts are V-shaped with an apex of the V forming the outer end 158, and base of the V-shape forming legs 162 that are attached to the main body 130. The tip of the outer ends 158 and 160 may be flared upward to facilitate engagement with the header contact ground shields 26.

The cover 90 includes a base shelf 164 and multiple differential shells 166 formed therewith. The base shelf 164 is mounted to the bottom layer 106 of the over-molded portion 86, such that the rear end 168 of the differential shells 166 abut against the front edge 110 of the over-molded portion 86. Mounting posts 170 on the cover 90 are received within holes 172 through the top and bottom layers 104 and 106. The mounting posts 170 may be secured to the holes 102 in a variety of manners, e.g. through a frictional fit, with adhesive and the like. Each differential shell 166 includes a floor 174, sidewalls 176 and a center wall 178. The side and center walls 176 and 178 define channels 180 that receive the receptacle contacts 96. The rear ends of the sidewalls 176 and center walls 178 include flared portions 182 and 184 that extend toward one another but remain spaced apart from one another to define openings 186 there between. Ramp blocks 188 are provided along the interior surfaces of the sidewalls 176 and along opposite sides of the center walls 178 proximate the rear ends thereof. The ramped blocks 188 support corresponding ramped portions 190 on the receptacle contacts 96.

Each terminal module 18 includes a cover 90 having at least one differential shroud or shell 166 enclosing an associated differential pair of contacts 96. Each shroud or shell 166 may have at least one open face (e.g., open top side 192) exposing the top or bottom of the contacts 96. As another alternative, the terminal module 18 may include multiple differential shrouds or shells 166 receiving corresponding differential pairs of contacts 96. Each shroud or shell 166 may include a floor 174, sidewalls 176, and a center wall 178 to form separate channels 180 to closely retain each receptacle contact 96. The floor 174, sidewalls 176 and center wall 178 have interior surfaces forming a curved contour that closely follows and conforms to the exterior surfaces of the contacts 96, in order to minimize the distance and air gap between the shell 166 and contacts 96.

The side walls 176, center wall 178, flared portions 182 and 184, and ramp blocks 188 define a cavity comprising the channel 180 and opening 186. The channel 180 includes open front and rear ends and one open side. The cavity closely proximates the shape of the fingers 102 on receptacle contacts 96. The walls of the cavity are spaced from the receptacle contacts 96 by a very narrow gap (approximately 0.1 mm). Hence, the contour of the cavity walls closely matches the contour of the receptacle contacts 96, thereby controlling impedance and enhancing the electrical performance.

The differential shells 166 include at least one open side. In the example of FIG. 4, each differential shell 166 includes an open top side 192. The top side 192 is maintained open to enhance electrical performance, specifically by controlling the impedance, by enabling the receptacle contacts 96 to be inserted into the cover 90 in a manner in which the fingers 102 of each receptacle contact 96 are closely spaced to the sidewalls 176, center wall 178, flared portions 182 and 184, and ramped portions 190. The open top side 192 is maintained open to enable the receptacle contacts 96 to be inserted into the differential shells 166 in a manner having a very close tolerance. Optionally, the floor 174 may be open and the top side 192 closed. The insulated walls 68 on the housing 16 close the open top sides 192 of each differential shell when the terminal modules 18 are inserted into the housing 16 (or open floor 174 if used).

When a receptacle 96 is located in a channel 180, the attached lead 92 extends through the opening 186 in the rear end of the differential shell 166. The fingers 102 engage a corresponding header contact 24 through the open front end of the differential shell 166. The open top side 192 is covered by insulating wall 68 when the terminal module 18 is inserted into the housing 16.

The contour of the cavity and the close tolerance achieved when the receptacle contacts 96 are inserted into the differential shells 166 enhances the electrical performance of the terminal module 18, and therefore the connector assembly 10. That is, because the side walls 176, center wall 178, flared portions 182 and 184, and ramp blocks 188 define a cavity comprising the channel and opening 186 that closely proximates the shape of the fingers 102 on the receptacle contacts 96, a relatively small amount of air surrounds the fingers 102 of the receptacle contacts 96 when the receptacle contacts 96 are inserted into the differential shells 166.

The amount of air that surrounds the fingers 102 of the receptacle contacts 96 is less than if the cavity were cube-shaped or another non-curved shape that did not conform to the contours of the fingers 102 of the receptacle contacts 96. Less air surrounds the receptacle contacts 96 because the cavity conforms to the contours of the fingers 102 of the receptacle contacts 96, and a close tolerance is achieved when the receptacle contacts 96 are inserted into the differential shells 166. The insulated walls 68 on the housing 16 close the open top sides 192 of each differential shell 166 when the terminal modules 18 are inserted into the housing 16 thereby keeping air gap within the cavity to a minimum. Because less air surrounds the fingers 102 of the receptacle contacts 96, impedance is kept within manageable limits. Consequently, the electrical performance of the connector assembly 10 is enhanced.

Figure 5:
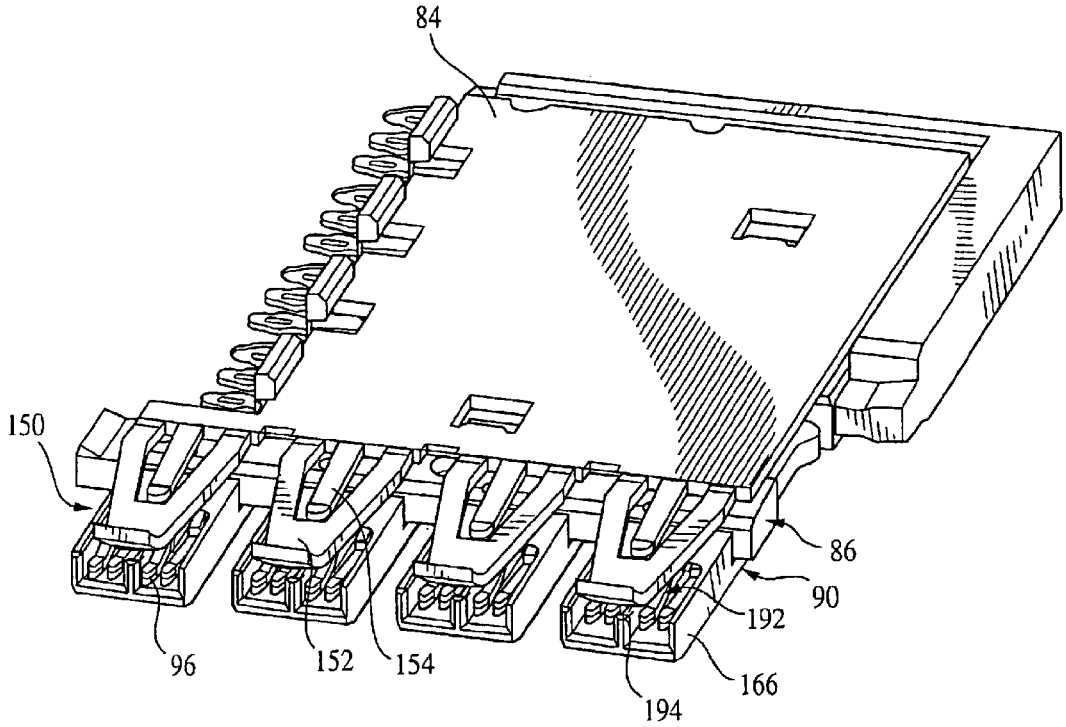
FIG. 5 illustrates an isometric view of a terminal module formed in accordance with an embodiment of the present invention.

FIG. 5 illustrates a terminal module 18 with the module ground shield 84 fully mounted upon the over-molded portion 86. The cover 90 is mounted to the over-molded portion 86. The ground contact assemblies 150 are located immediately over the open top sides 192 of each differential shell 166 with a slight gap 194 there between. The primary and secondary ground contacts 152 and 154 are spaced a slight distance above the receptacle contacts 96.

When the terminal module 18 is inserted into the insulated housing 16 (FIG. 6), the insulated walls 68 are slid along gaps 194 between the ground contact assemblies 150 and receptacle contacts 96. By locating the insulated walls 68 over the open top sides 192 of each differential shell 166, the connector assembly 10 entirely encloses each receptacle contact 96 within an insulated material to prevent arching between receptacle contacts 96 and the ground contact assemblies 150 and to control impedance and signal integrity. Once the terminal modules 18 are inserted into the insulated housing 16, the primary and secondary ground contacts 152 and 154 align with the L-shaped notches 70 cut through the mating face 28 on the front of the insulated housing 16. The receptacle contacts 96 align with the contact receiving holes 72. When interconnected, the header contact ground shields 26 are aligned with and slide into notches 70, while the header contacts 24 are aligned with and slide into contact receiving holes 72.

As the header contact ground shields 26 are inserted into the notches 70, the primary ground contact 152 initially engages the tip 47 of the rear surface 45 of a corresponding blade portion 42. The primary ground contacts 152 are dimensioned to engage the tip 47 of the header contact ground shield 26 before the header and receptacle contacts 24 and 96 touch to prevent shorting and arching and to establish a ground connection before a signal connection. As the header contact ground shields 26 are slid further into the notches 70, the tips 47 of the blade portions 42 engage the outer ends 160 of the secondary ground contact 154 and the outer ends 158 of the primary ground contacts 152 engage the intermediate portion 49 of the blade portion 42. When the receptacle 12 and header 14 are in a fully mated position, the outer end 158 of each primary ground contact 152 abuts against and is in electrical communication with a base 41 of a corresponding blade portion 42, while the outer end 160 of the secondary ground contact 154 engages the blade portion 42 at an intermediate point 49 along a length thereof. Preferably, the outer end 160 of the secondary ground contact 154 engages the blade portion 42 proximate the tip 47 thereof.

The primary and secondary ground contacts 152 and 154 move independent of one another to separately engage the header contact ground shield 26. By engaging the header contact ground shield 26 at an intermediate portion 49 with the secondary ground contact 154, the header contact ground shield 26 does not operate as a stub antenna and does not propagate EM interference. Optionally, the outer end 160 of the secondary ground contact 154 may engage the header contact ground shield 26 at or near the tip 47 to further prevent EM interference. The length of the secondary ground contacts 154 affect the force needed to fully mate the receptacle 12 and header 14. Thus, the secondary ground contacts 154 are of sufficient length to reduce the mating force to a level below a desired maximum force. Thus in accordance with at least one preferred embodiment, the primary ground contacts 152 engage the header contact ground shield 26 before the header and receptacle contacts 24 and 96 engage one another. The secondary ground contact 154 engages the header contact ground shields 26 as closely as possible to the tip 47, thereby minimizing the stub antenna length without unduly increasing the mating forces.

Optionally, the ground contact assembly 150 may be formed on the header 14 and the ground shields 26 formed on the receptacle 12. Alternatively, the ground contact assemblies 150 need not include V-shaped primary ground contacts 152. For example, the primary ground contacts 152 may be straight pins aligned side-by-side with the secondary ground contacts 154. Any other configuration may be used for the primary and secondary contacts 152 and 154 so long as they contact the ground shields 26 at different points.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical connector assembly comprising:

a header connector;

an array of signal contacts secured to said header connector and arranged in a pattern of signal contact pairs;

an array of ground shields secured to said header connector, each ground shield having one of an L-shape and C-shape and isolating only one side and at least one end of a corresponding signal contact pair; and a receptacle connector including a mating face having an array of contact-receiving holes, said contact-receiving holes being arranged in hole pairs corresponding to said pattern, said hole pairs being matable with said signal contact pairs, each hole pair including first and second holes spaced apart by a hole-to-hole distance, each hole pair being spaced apart from adjacent hole pairs by a hole pair-to-pair distance that differs from said hole-to-hole distance, said hole-to-hole distance within a first hole pair being less than said hole pair-to-pair distance between any of said adjacent hole pairs, wherein said mating face of said receptacle connector further includes an array of notches adapted to receive said ground shields, each notch having one of an L-shape and C-shape that partially surrounds a corresponding hole pair, wherein each notch includes a blade receiving portion and at least one leg receiving portion, said at least one leg receiving portion having a length that differs from a length of said blade receiving portions.

2. The electrical connector assembly of claim 1, wherein said blade receiving portion extends parallel to, and along a common side of, both contact-receiving holes in a corresponding hole pair.

3. The electrical connector assembly of claim 1, wherein said blade receiving portion is aligned parallel to a differential hole pair axis that extends through both contact receiving holes in a corresponding hole pair.

4. The electrical connector assembly of claim 1, wherein each said blade receiving portion extends along one common side of both contact-receiving holes in a corresponding hole pair.

5. The electrical connector assembly of claim 1, wherein each notch covers one common side of both contact-receiving holes and at least one end of a corresponding hole pair, and leaves open an opposite common side of both contact-receiving holes of said corresponding hole pair.

6. The electrical connector assembly of claim 1, wherein each ground shield includes one open side exposing said corresponding signal contact pair.

7. The electrical connector assembly of claim 1, further comprising a first ground shield isolating adjacent first and second signal contact pairs arranged in a common column of said pattern, said first ground shield isolating said first signal contact pair from an adjacent third signal contact pair arranged in a common row of said pattern.

8. The electrical connector assembly of claim 1, wherein only a single ground shield is located between adjacent signal contact pairs in each row and each column of said pattern.

9. The electrical connector assembly of claim 1, wherein only a single notch is located between adjacent hole pairs in each row and in each column of said pattern.

10. The electrical connector assembly of claim 1, wherein each hole pair is oriented along a respective hole pair axis extending through centers of respective first and second contact-receiving holes, and wherein each of said blade notch portions is aligned parallel to a corresponding hole pair axis.

11. The electrical connector assembly of claim 1, wherein each hole pair is oriented along a respective hole pair axis extending through centers of respective first and second contact-receiving holes, and wherein each of said leg notch portions is aligned perpendicular to a corresponding hole pair axis.

12. An electrical connector assembly comprising:

a header having a header mating face;

contacts extending from said header and configured to carry differential signal pairs, said contacts being organized in multiple differential pairs, said differential pairs being arranged on said header mating face in a contact pattern with adjacent differential pairs aligned in rows and columns, each differential pair including two contacts spaced apart by a first distance, adjacent differential pairs in said rows and columns being spaced apart by a second distance that is greater than said first distance, said first distance within a first differential pair being less than said second distance between any of said adjacent differential pairs;

an array of ground shields having one of an L-shape and C-shape and being secured to said header and extending from said header mating face, wherein each ground shield includes a blade portion extending along at least one common side of said two contacts of an associated differential pair of contacts and includes at least one leg portion extending along at least one end of said associated differential pair of contacts, wherein each said blade portion has a length that differs from a length of each of said leg portions; and a receptacle having a receptacle mating face with holes arranged in a hole pattern corresponding to said contact pattern.

13. The electrical connector assembly of claim 12, further comprising an array of notches in said receptacle mating face adapted to receive ground shields, each notch having one of an L-shape and C-shape that partially surrounds a corresponding pair of holes receiving a differential pair of contacts.

14. The electrical connector assembly of claim 12, wherein each differential pair is oriented along a differential pair axis extending through centers of respective first and second contacts in said differential pair, and further comprising a plurality of ground shields secured to said header, each ground shield having a blade portion aligned parallel to a corresponding differential pair axis.

15. The electrical connector assembly of claim 12, wherein each differential pair is oriented along a differential pair axis extending through centers of respective first and second contacts in said differential pair, and further comprising a plurality of ground shields secured to said header, each ground shield having at least one leg portion aligned perpendicular to a corresponding differential pair axis.

* * * * *